US006087572A

United States Patent [19]

Dillon

[11] Patent Number: 6,087,572

[45] Date of Patent: Jul. 11, 2000

[54] ADJUSTABLE RECEIVER FOR BRASS MUSICAL INSTRUMENTS

[76] Inventor: Steve R. Dillon, 58 Delikat La., Sayreville, N.J. 08872

[21] Appl. No.: 09/056,257

[22] Filed: Apr. 6, 1998

[51] Int. Cl.[7] ..... G10D 7/10

[52] U.S. Cl. ..... 84/387 R; 84/398

[58] Field of Search ..... 84/387, 398, 399, 84/387 R

[56] References Cited

U.S. PATENT DOCUMENTS

| | | | |
|---|---|---|---|
| 2,987,950 | 6/1961 | Kent | 84/388 |
| 3,191,483 | 6/1965 | Williams . | |
| 3,808,935 | 5/1974 | Reeves | 84/399 |
| 4,178,830 | 12/1979 | Ramirez | 84/398 X |
| 4,273,020 | 6/1981 | Happe | 84/387 R X |
| 4,559,859 | 12/1985 | Pilczuk | 84/387 R X |
| 5,218,150 | 6/1993 | Pastor | 84/398 |
| 5,847,300 | 12/1998 | Hackl | 84/398 |

*Primary Examiner*—Jeffrey Donels
*Attorney, Agent, or Firm*—Michael L. Lynch

[57] ABSTRACT

An adjustable receiver is provided for use on brass musical instruments. The adjustable receiver includes a barrel which is coupled to the end of the instrument leadpipe, and a receiving member which is telescopingly received within the barrel. Receiving member is configured to receive the instrument leadpipe. Receiving member is longitudinally movable relative to the barrel, such as through use of a threaded coupling.

12 Claims, 5 Drawing Sheets

ADJUSTABLE RECEIVER FOR BRASS MUSICAL INSTRUMENTS

BACKGROUND OF THE INVENTION

The present invention relates generally to receivers for brass musical instruments, and more specifically relates to receivers which facilitate alteration of the position of a selected mouthpiece relative to the leadpipe of the instrument. The adjustable receiver has been shown to offer particularly significant advantages when used on "low brass" relatively conical bore instruments, such as tubas and euphoniums.

As used herein, the term "brass instrument" is used to define that family of instruments conventionally identified by that term: instruments played with a generally cup-shaped mouthpiece, such as trumpets, trombones, euphoniums, tubas, etc.; regardless of the actual material of manufacture. It is well known in the art of brass instrument making that a critical portion of the instrument is that from the mouthpiece to the valve cluster. In most conventional instruments, this portion of the instrument consists of three elements: the leadpipe, which couples at its proximal end to the valve cluster; the mouthpiece receiver which is secured, typically by soldering, to the distal end of the leadpipe to facilitate acceptance of a mouthpiece; and the mouthpiece itself. The mouthpiece has a rim which contacts the player's face, a bowl area below the rim, and a shank which partially extends into the mouthpiece receiver.

Focusing upon the mouthpiece shank, the shank will contain a backbore, which begins at a throat, or aperture from the mouthpiece bowl, and which expands at a selected rate (or "taper") to the end of the shank. The shank will also have a selected external taper, and will decrease in diameter approaching the end of the shank (in contrast to the expanding taper of the backbore within the shank). As is well known in the art, for any given type of brass instrument (trumpet, trombone, euphonium, tuba, etc.), seemingly endless numbers of variations are made in these mouthpiece elements to accommodate individual players and to function satisfactorily as an interface between those players and a specific brass instrument.

Similarly, it is well known in the art of brass instrument making that the pattern of taper defined by the leadpipe, and the general conformation of the leadpipe, can make significant differences in how a brass instrument plays, in terms of tone, intonation, response, and size of sound. These characteristics are readily recognized, to the result that manufacturers of conventional brass instruments, and in particular of tubas, may offer multiple leadpipes which may be interchangeably affixed to an instrument to facilitate the player tailoring the characteristics of that instrument either to himself, or to a particularly desired performance characteristic.

Unlike mouthpieces and leadpipes, receivers have, prior to the present invention, been essentially a fixed aspect of the instrument. Although many different designs of receivers are known, they are typically defined relative to two primary aspects: (1) having a proximal bore sized to receive the end of the leadpipe; and (2) having a distal end having a taper configured to receive a selected taper of mouthpiece shank. This conventional design has offered significant limitations. First, if a player wished to utilize a mouthpiece having a shank with a taper different from that accommodated by the receiver on the instrument, then the player had to insert the mouthpiece to the extent necessary, and live with a mismatch between the tapers. In some cases, wherein the mouthpiece included a shank smaller than the receiver, the mouthpiece might extend into the receiver a greater distance than would have been intended or would have been desirable, and in some cases players might shim the mouthpiece with paper or a similar substance. Of course, where the mouthpiece shank is larger, the mouthpiece could only be placed in as far as possible. In some cases, specific mouthpieces may not be utilizable with a particular instrument having a conventional fixed receiver.

In individual cases, there has been speculation that a mismatch between a receiver and/or a mouthpiece shank might lead to less than optimal playing characteristics; yet there has not been an option other than use of another mouthpiece (in some cases a copy of the desired mouthpiece, but with a different shank configuration), or, in some cases, to utilize a mouthpiece assembly having an interchangeable shank.

Another deficiency of conventional receivers is that, even with an appropriately tapered mouthpiece shank, they establish a single, fixed relationship between the mouthpiece and the leadpipe. It has been speculated that altering the dimensions of this space may have an effect upon the intonation of the instrument. See U.S. Pat. No. 4,273,020, issued Jun. 10, 1981 to Happe. However, even with such speculation, U.S. Pat. No. 4,273,020 offers no suggestions about how such alteration might occur; and focuses upon making changes in a tunable leadpipe. The present inventor, has discovered that changes in the position of the mouthpiece shank relative to the leadpipe can yield dramatic differences in many aspects of the instrument's characteristics, including responsiveness and tone color.

In most receiver/mouthpiece combinations, a space is formed between the end of the mouthpiece and the instrument leadpipe. With conventional fixed receivers, the taper which begins at the throat of the mouthpiece, and expands through the backbore of the mouthpiece, through the space in the receiver, and through the leadpipe, may be less than optimal for either a given player, a given instrument, or for the playing characteristics desired from that instrument on a given day.

It should be noted that instruments are known which include movable sections within the leadpipe. In all known conventional instruments, these movable sections are utilized for tuning, and may include either a U-shaped tuning slide, as is found in some tubas and euphoniums; or a straight slide as is found on smaller instruments, such as the trumpet depicted in U.S. Pat. No. 4,273,020. These designs, although they change the physical length of the leadpipe and the valve cluster, still suffer from the drawbacks of a fixed relationship between the mouthpiece and the receiver, and a fixed distance between the mouthpiece and the beginning of the leadpipe of the instrument.

Accordingly, the present invention provides for an adjustable receiver for use on a brass instrument, which receiver will facilitate adjustment of the placement of the mouthpiece relative to the distal end of the leadpipe. In a preferred embodiment, the receiver facilitates the defining of an adjustable chamber between the end of the mouthpiece shank and the distal end of the leadpipe; and further facilitates the mounting of multiple configurations of mouthpiece shanks to a single instrument without mismatch of tapers of engaging surfaces.

SUMMARY OF THE INVENTION

The adjustable receiver in accordance with the present invention includes a barrel member which is configured to be coupled to the leadpipe of the instrument, and also includes a receiving sleeve which is detachably coupled to the barrel member. The receiving sleeve has surfaces defining a bore having a selected size and taper to form a close-fitting mechanical engagement with a selected configuration of mouthpiece shank. The receiving member is longitudinally movable relative to the barrel member, facilitating adjustment of the distance between the end of the mouthpiece shank and the adjacent end of the instrument leadpipe. In a particularly preferred embodiment, this longitudinal adjustment is achieved through use of a threaded coupling between the receiving member and the barrel member. Also in a particularly preferred embodiment, a locking member is provided to selectively secure the receiving member in a selected position relative to the barrel.

In one preferred implementation, a plurality of receiving members may be utilized in combination with a single barrel coupled to the instrument leadpipe, with each receiving member configured to engage a selected mouthpiece shank configuration utilizing such a combination, a variety of shanks may also be utilized on a single instrument, with a desired mechanical engagement between the mouthpiece and the instrument may be adjusted in relation to the leadpipe.

DETAILED DESCRIPTION OF PREFERRED EMBODIMENT

Figure 1:
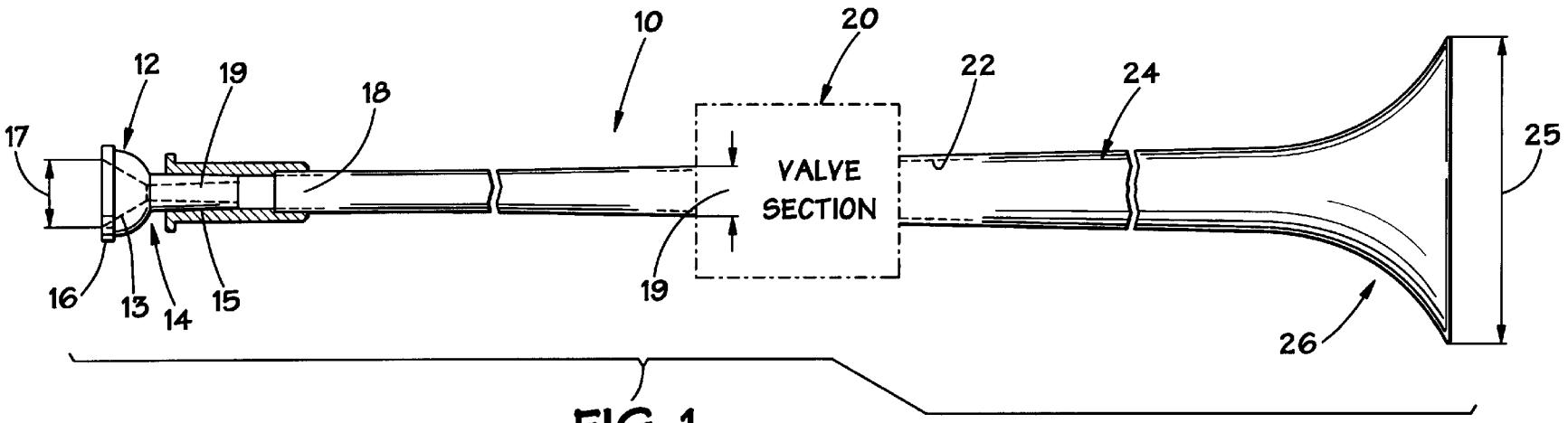
FIG. 1 is a schematic depiction of the tube cross section through a conical-bore brass instrument, such as a horn, euphonium or tuba.

Referring now first to FIG. 1 in more detail, therein is schematically depicted the bore through a conventional conical-bore brass instrument 10, such as a tuba. Instrument 10 includes a mouthpiece 12 which is schematically depicted as a decreasing funnel area, indicated generally at 13. Although mouthpiece funnel 13 may be depicted as having linearly defined surfaces, those skilled in the art will recognize that the tapers within the mouthpiece 12 may vary from roughly linear surfaces to a relative bowl shape. At the base of mouthpiece funnel (or bowl) 13 is the throat of the mouthpiece, indicated generally at 14. Throat 14 will typically be the narrowest portion of the bore through the entire instrument 10. In a conventional tuba, for example, the opening rim 16 of mouthpiece 12 may have an inner diameter 17 on the order of approximately 1.2 inches, while the inner diameter of mouthpiece throat 14 may be roughly on the order of 0.38 inch.

In general form, the bore through instrument 10 will expand, with varying tapers at different locations through the backbore 19 within shank 15 of mouthpiece 12 and through the leadpipe of the instrument, indicated generally at 18, to a nominal bore size, at 19, which will, in most cases, extend through at least a majority of the valve section, indicated in block diagram form at 20.

Particularly in lower brasses, such as trombones, euphoniums and tubas, etc, the end of the leadpipe to which the receiver is affixed is the smallest portion of the tubing secured in fixed relation to the remainder of the instrument. This is true, even where a tuning slide may be included prior to reaching the valve section, in valved brass instruments. As noted above, in smaller brasses, the leadpipe may be formed in two sections sufficiently movable relative to one another to facilitate tuning of the instrument.

Although nominal bore sizes may vary dramatically, even within instruments of a single family, a conventional tuba, for example, might have a bore ranging from approximately 0.62 inch to 0.835 inch through much of the valve section; with a nominal bore size of 0.750 inch being relatively common. Valve section 20 is depicted in block diagram form as its specific configuration is not directly relevant to the invention at hand.

As is well known in the art, a valve section will typically include from three to six valves, with three and four valve configurations being most common. An instrument may also have fewer than two valves for instruments not figured to play a chromatic scale (such as instruments in the bugle family). In some cases, the nominal bore size will expand through the valve section, most typically after the first three valves within the section. However, in virtually all cases, the bore 22 after the last valve will expand at an increasing rate through the larger branches of the instrument, as indicated generally at 24, until a final relatively rapid flare at the bell of the instrument, indicated generally at 26. The bell diameter 25 of a tuba may commonly be, for example, 15 to 22 inches.

As previously noted herein, it is well recognized that changes in the dimension of the expanding bore of the instrument, and/or of the rate of taper can have dramatic effects upon various performance characteristics of the instrument. The changes achievable through variations in the tapers in the smaller portion of the instrument bore, leadpipe region 18, have prompted extensive work in developing and customizing leadpipes. Previous to the present invention, however, no control was offered over the interface of the mouthpiece shank to the instrument receiver, and of the placement of that mouthpiece shank relative to the instrument leadpipe.

Figure 2:
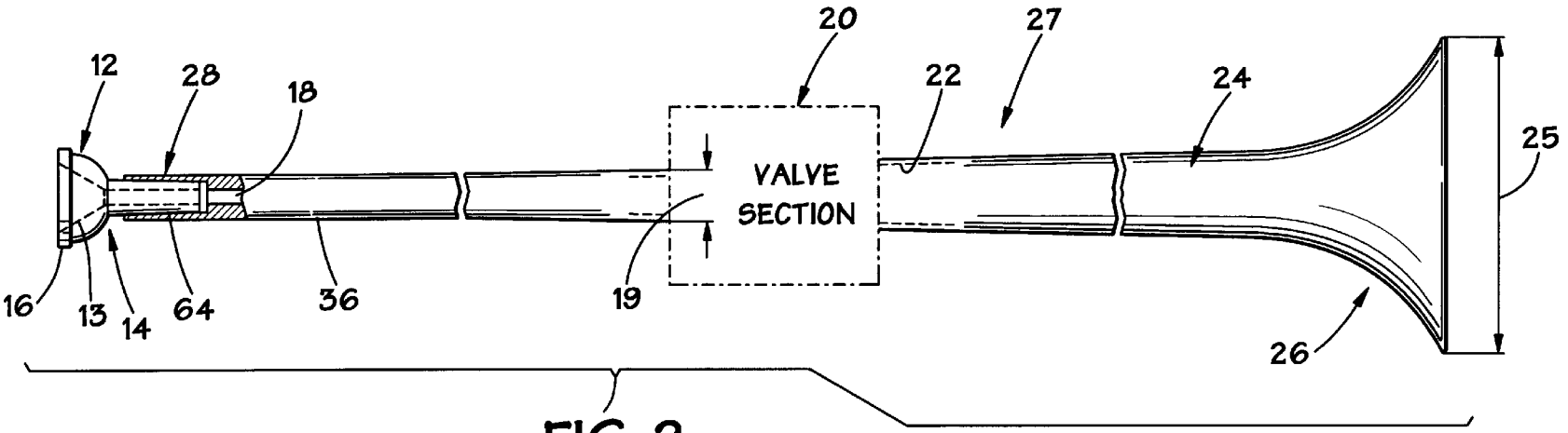
FIG. 2 is a schematic depiction of the tubing cross section through a conical-bore brass instrument, utilizing an adjustable receiver in accordance with the present invention.
Figure 3:
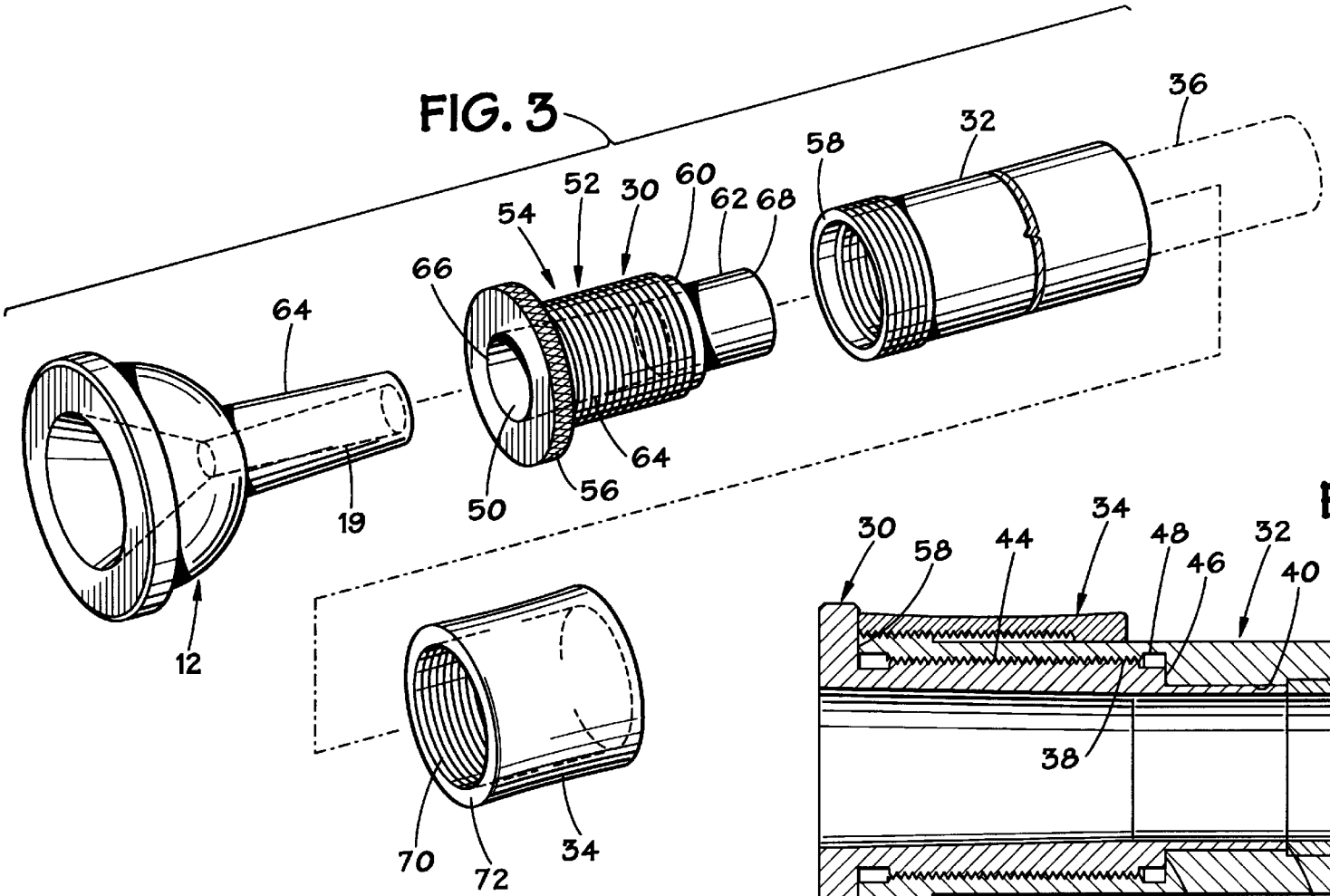
FIG. 3 depicts an adjustable receiver in accordance with the present invention, illustrated from a side view.
Figure 4:
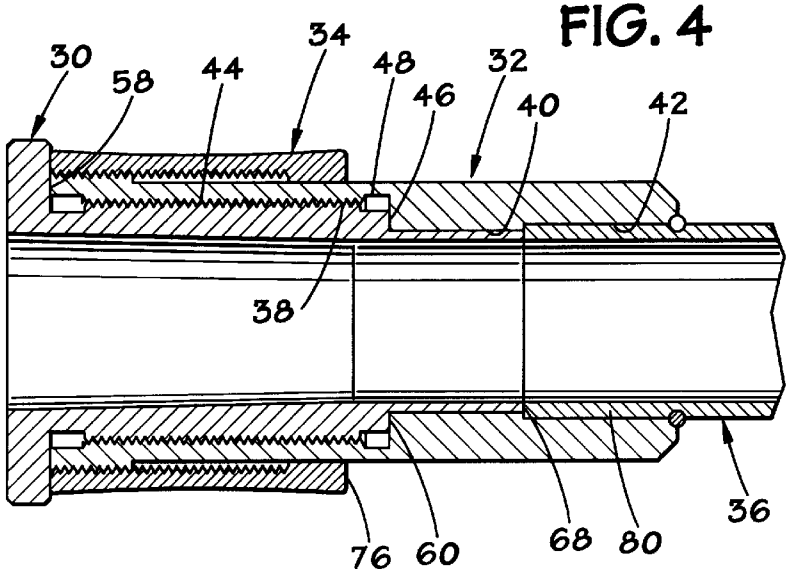
FIG. 4 depicts the adjustable receiver of FIG. 3, depicted in vertical section.
Figure 5:
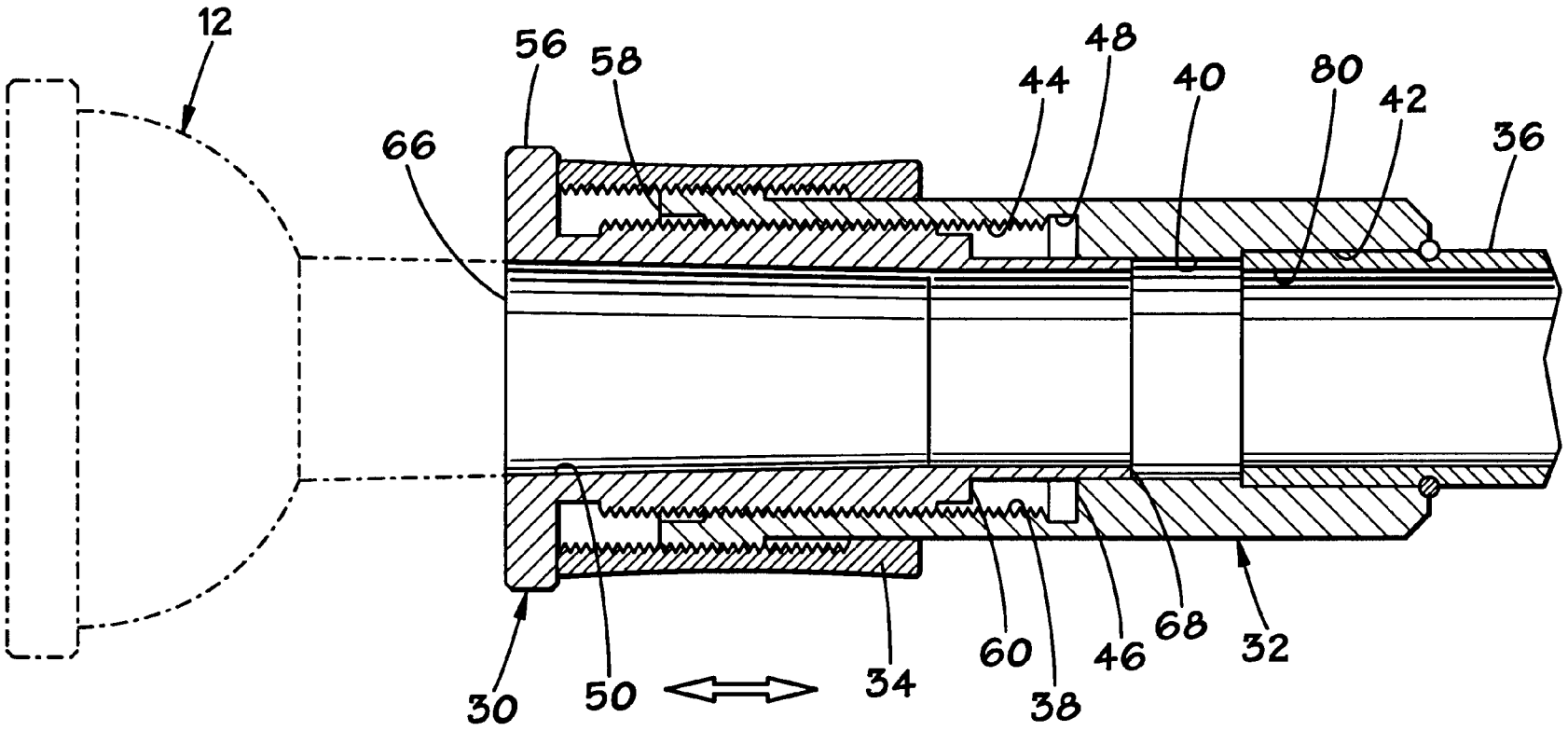
FIG. 5 depicts the adjustable receiver of FIGS. 3 and 4 in an exploded view.

Referring now to FIG. 2 in more detail, therein is depicted a similarly constructed instrument 27 fitted with an adjustable receiver 28 in accordance with the present invention. Reference is also made to FIGS. 3, 4 and 5 which depict adjustable receiver 28 in greater detail. Adjustable receiver 28 includes a receiving sleeve 30, a barrel 32 and a locking sleeve 34. Barrel 32 is configured for attachment to leadpipe 36 of the instrument to which receiver 28 is affixed. Barrel 32 is a generally cylindrical member defining two longitudinally-aligned coaxial bores, upper bore 38 and lower bore 40. Lower bore 40 will be configured to engage the distal end 80 of leadpipe 36. In a particularly preferred installation, lower bore 40 will have an enlarged upset area 42 defined therein to receive the distal end 80 of leadpipe 36. Where such an upset 42 is provided, upset 42 may be sized to a selected dimension or may be left to be formed at the time of installation to "customize" the upset dimensions for the specific leadpipe and leadpipe wall thickness which barrel 32 will engage. In a particularly preferred embodiment, lower bore 40 (and upset 42 where provided) will have a smooth cylindrical bore therethrough. Upper bore 38 is of a relatively enlarged dimension relative to lower bore 40, and includes a threaded region 44 extending from proximate the distal end 58 of barrel 32 to proximate shoulder 46 formed at the transition between upper bore 38 and lower bore 40. A thread relief 48 is preferably provided between the lower extent of threaded region 44 and shoulder 46. Barrel 32 also includes external threads 41 extending inwardly from its distal end 58, for a short distance (for example, 0.25 inch).

In a illustrative embodiment, for example, barrel 32 may have an inner diameter of 0.600 inch in lower bore 40, and the upper bore 38 may have an inner diameter at the inner extent of threaded section 44 of approximately 0.665 inch. Dimensions are provided herein to convey illustrative dimensions relative to one another. These dimensions are illustrative only, and many variations may be made within any specific dimension, and within relative scaling of dimensions within adjustable receiver 28.

Receiving sleeve 30 defines an inner tapered bore 50 configured to receive a mouthpiece shank, and has a compound exterior surface configured to engage upper bore 38 and lower bore 40 of barrel 32. Compound exterior surface 52 includes a threaded region 54 sized and configured to threadably engage threaded region 44 in upper bore 38. Threaded region 54 will extend over a sufficient dimension to facilitate the desired degree of adjustment within adjustable receiver 28. In the illustrated embodiment, threaded region 54 extends over a longitudinal distance of approximately 0.60 inch, and facilities engagement from a forward retracted position, as depicted in FIG. 4 (wherein flange 56 contacts distal end 58 of barrel 32, and in which an inner shoulder 60 contacts shoulder 46 within barrel 32) to a relatively extended position, as desired (and as depicted in FIG. 5).

Compound exterior surface 52 of receiving sleeve 30 includes a barrel extension 62 which is telescopingly received within lower bore 40 of barrel 32. The exterior surface of extension 62 is sized to closely engage the sidewall defining lower bore 40 to minimize air leakage past the interface between the surfaces. A knurled periphery 64 is provided on flange 56 to facilitate easy rotation of receiving sleeve 30 relative to barrel 32 so as to enable placement of receiving sleeve 30 in any desired position of relation and/or extension relative to barrel 32.

Inner bore 50 of receiving sleeve 30 is configured to receive a mouthpiece shank 64 of a specific conformity. The specific dimensions of inner bore 50 will thus be specific to a known shank size and taper, or may be customized for an individual mouthpiece shank. For example, in a receiving sleeve specifically configured to engage a conventional "American-style" tuba mouthpiece shank, inner bore 50 would have a dimension at distal end 66 of approximately 0.590 inch, and a dimension at proximal end 68 of approximately 0.525 inch, with a dimension from distal end 66 to proximal end 68 of approximately 1.395 inches. By contrast, in a receiving sleeve specifically configured to engage a conventional, larger, "European-style" tuba mouthpiece shank, inner bore 50 will have a dimension at distal end 66 of approximately 0.620 inch, and a dimension at proximal end 68 of approximately 0.550 inch, again with a dimension from distal end 66 to proximal end 68 of approximately 1.395 inches. Although specific implementations may vary as desired, in a particularly preferred implementation the dimensions of bore 50 will be established such that the end of a shank (64) of an intended size will extend to be approximately flush with distal end 68 of receiving sleeve 30. As will be appreciated by those having the benefit of this disclosure, multiple configurations of receiving sleeves may be manufactured to engage barrel 32; thus facilitating the establishing of an optimal mechanical engagement between a mouthpiece and the instrument.

Locking sleeve 34 is retained coaxially with barrel 32, and includes internal threads 70 sized to engage external threads 41 on barrel 32. Thread 70 extends from distal end 72 of locking sleeve 34 for a distance sufficient to facilitate adjustment throughout the configured range of adjustment of receiving sleeve 30 relative to barrel 32. In the illustrative embodiment, thread 70 extends approximately 0.60 inch from distal end 70 of locking sleeve 34. In a particularly preferred embodiment, locking ring 34 includes an inner annular shoulder 76 sized to engage the exterior surface of barrel 32 to promote stability and placement of locking sleeve 34 relative to barrel 32. Locking sleeve 34 may be provided with an external contour, such as a longitudinally convex profile to ease grasping and rotating of the sleeve.

In operation, once barrel 32 and locking sleeve 34 are installed upon a particular instrument, virtually any mouthpiece for that type of instrument may be utilized with the instrument. Additionally, the placement between the selected mouthpiece and the leadpipe of the instrument may be adjusted for optimized performance of that combination. For any individual mouthpiece, a player may select an appropriate receiving sleeve 30 which is sized to fit the shank 64 of the mouthpiece which is desired for use with the instrument. Receiving sleeve 30 is then inserted into barrel 32 until threaded section 54 engages threads 44 within barrel 32. The mouthpiece may be inserted into receiving sleeve 30, and the player can test the combination of the mouthpiece and the instrument in various placements, adjusting the longitudinal position of the mouthpiece relative to the leadpipe by threading or unthreading receiving sleeve 30 relative to barrel 32.

As can best be seen in FIG. 5, adjustment of receiving sleeve 30 outwardly relative to barrel 32 will result in a chamber 78 being formed with a gap between proximal end 68 of receiving sleeve 30 and distal end 80 of leadpipe 36. With an innermost adjustment of receiving sleeve 30 relative to barrel 32, as depicted in FIG. 4, the expanding taper of backbore 17 of mouthpiece will generally continue through the tapers present in leadpipe 36. The minimum dimension of spacing between the end of receiving sleeve 30 and the adjacent leadpipe can be established either by the longitudinal dimension of the upset 42, or by the placement of the leadpipe at installation.

With outward adjustment of receiving sleeve 30, a cylindrical section 19 is introduced in the taper. It has been empirically found that the altering of the size of this section 19 between the mouthpiece shank and distal end 80 of leadpipe 18 facilitates significant changes in the response characteristics of the instrument.

Although not wishing to be bound by theory, the varying of this chamber has been analogized to a fulcrum for the air stream. Just as a mechanical fulcrum may be adjusted in width to varying the stability and movement of a mechanism balanced on the fulcrum; it is believed that the varying of the cylindrical section in the air stream may facilitate "balancing" forces defining various response characteristics generated in this relatively narrow portion of the air stream within the brass instrument.

Figure 6:
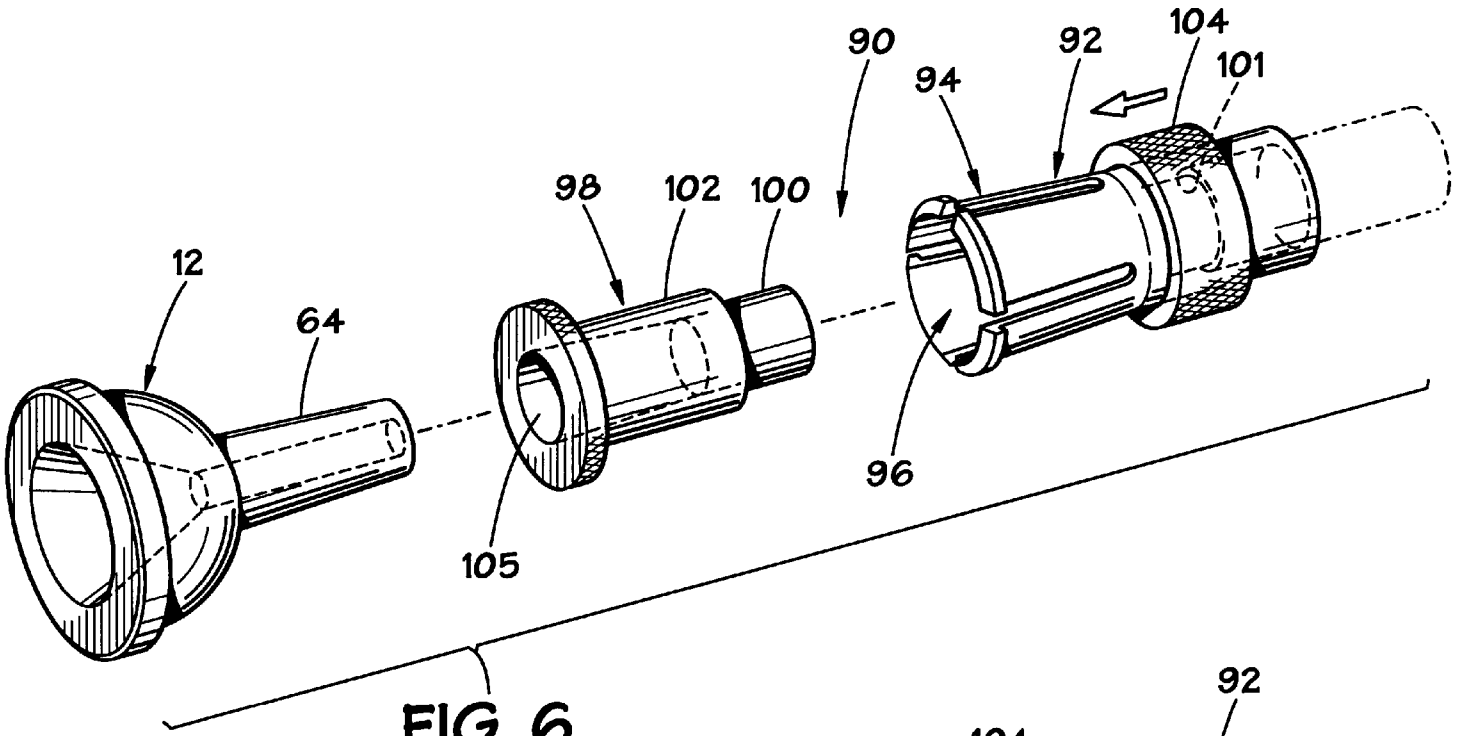
FIG. 6 depicts an alternative embodiment of an adjustable receiver in accordance with the present invention, illustrated coupled to a lead pipe and in an exploded view.
Figure 7:
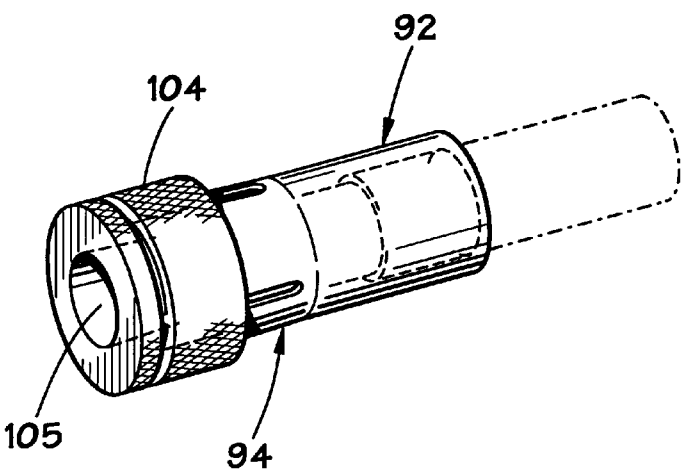
FIG. 7 depicts the receiver of FIG. 6 in an assembled view.

Referring now to FIGS. 6 and 7, therein is depicted an alternative embodiment of an adjustable receiver 90. Adjustable receiver 90 varies from receiver 28 in that barrel 92 has a plurality of collet fingers 94 formed in an upper portion thereof. Collet fingers 94 will be formed in an area defining a relatively enlarged upper bore 96. A receiving sleeve 98 will again include a compound exterior form, having a relatively small diameter extension 100 sized to extend into a complimentary bore 101 within barrel 92, which bore will primarily be placed inwardly of collet fingers 94; and a relatively enlarged portion 102 sized to fit within complimentary bore 96 within collet fingers 94. Receiving sleeve 98 will have an inner bore 105 configured as described relative to receiving sleeve 30. The outer contours of collet fingers 94 are tapered so that a locking ring 104 may be slid over collet fingers 94, compressing the collet fingers 94 together and thereby retaining receiving sleeve 98 at a selected position relative to barrel 92. Locking ring 104 may either engage collet fingers by a friction interference fit, or appropriate threads (not illustrated) may be placed on collet fingers 94 to facilitate threaded compression of collet fingers 94 in a conventional manner.

Figure 8:
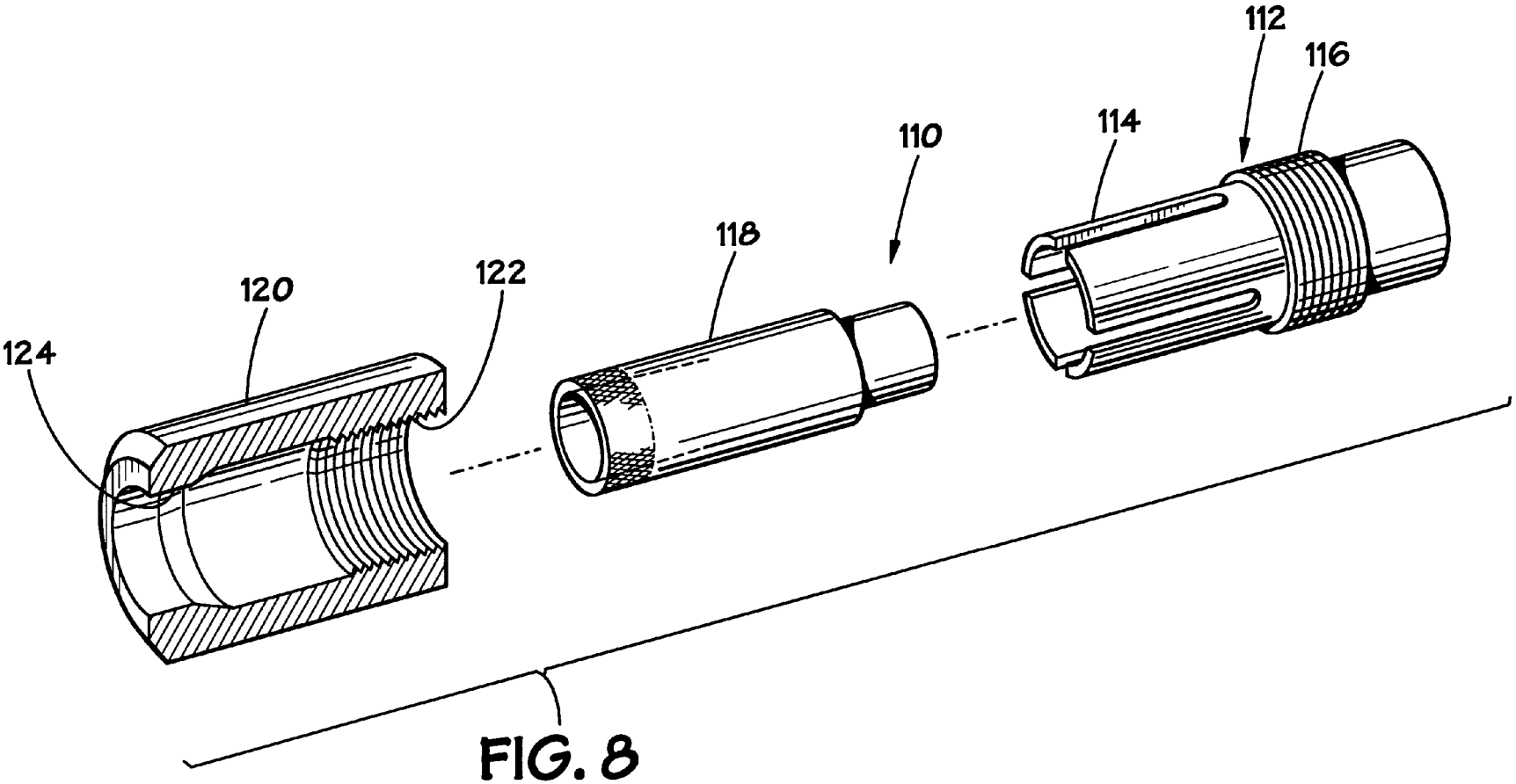
FIG. 8 depicts another alternative embodiment of an adjustable receiver in accordance with the present invention.

Referring now to FIG. 8, therein is depicted an alternative embodiment of an adjustable receiver 110 utilizing a collet mechanism. In adjustable receiver 110, barrel 112 again includes a plurality of collet fingers 114 at the distal end. Barrel 112 also includes a plurality of threads 116 toward a lower portion thereof. A receiving sleeve 118, again sized to receive a specific mouthpiece shank configuration, is sized to slidably engage complimentary bores within barrel 112. A locking sleeve 120 is configured to extend over the mouthpiece shank, and over receiving sleeve 118 to engage barrel 112. Locking sleeve 120 includes a plurality of threads 122 which engage threads 116 on barrel 112. A shoulder 124 on locking sleeve 120 is sized to engage collet fingers 114, and to gradually urge them inwardly to secure receiving sleeve 118 in a fixed position as locking sleeve 120 is threadably engaged with barrel 112.

Many modifications and variations may be made in the techniques and structures described and illustrated herein without departing from the spirit and scope of the present invention. Accordingly, the embodiments described and illustrated herein are illustrative only and are not to be considered as limitations upon the scope of the present invention. For example, the region between the end of the mouthpiece shank and the leadpipe has been described as being generally cylindrical. In some applications, however, other contours may be defined in such a region, if desired.

What is claimed is:

1. A mouthpiece receiver configured to couple the shank of a mouthpiece to a brass instrument having a leadpipe, comprising:

a first member coupled to said leadpipe of said instrument;

a receiving member configured to receive said shank of said mouthpiece, said receiving member telescopingly received in longitudinally-movable relation to said first member; and a locking member configured to retain said receiving member in a desired placement relative to said first member.

2. The mouthpiece receiver of claim 1, wherein said receiving member is threadably coupled to said first member, and wherein longitudinal movement of said receiving member relative to said first member is achieved through rotation of said threaded coupling.

3. An assembly configured to couple a mouthpiece having a shank portion to a leadpipe of a musical instrument, comprising:

a barrel assembly coupled to said leadpipe, said barrel assembly having at least one bore therethrough;

a receiving member having a bore therethrough, said bore configured to receive said shank of said mouthpiece, said receiving member configured to engage said bore of said barrel assembly and to be longitudinally movable within at least a portion of said bore, said receiving member coupled to said barrel assembly through a threaded coupling.

4. The assembly of claim 3, further comprising a retention member coupled in movable relation to said barrel assembly, and cooperatively configured with said barrel assembly and said receiving member to move between a first position wherein said locking member allows longitudinal movement between said receiving member and said barrel assembly and a second position wherein said retention member restricts longitudinal movement between said receiving member and said barrel assembly.

5. The assembly of claim 4, wherein said retention member is threadably coupled to said barrel assembly.

6. An assembly configured to couple a mouthpiece having a shank portion to a leadpipe of a musical instrument, comprising:

a barrel assembly coupled to said leadpipe, said barrel assembly having at least one bore therethrough, said barrel comprising a plurality of collet fingers;

a receiving member having a bore therethrough, said bore configured to receive said shank of said mouthpiece, said receiving member configured to engage said bore of said barrel assembly and to be longitudinally movable within at least a portion of said bore.

7. A musical instrument intended to be played with a mouthpiece having a shank, comprising:

a leadpipe having a taper therein, said leadpipe having a distal end;

a barrel coupled in fixed relation to said distal end of said leadpipe, said barrel defining a first bore;

a movable member disposed within said bore, said movable member telescopingly coupled to said barrel, said movable member defining a second bore, said second bore configured to receive a mouthpiece shank of a selected configuration; and a locking member operably associated with at least one of said movable member and said barrel, and movable to at least one position wherein said locking member restricts movement between said movable member and said barrel.

8. The instrument of claim 7, when said instrument further comprises:

a valve section coupled to said leadpipe; and a bell at the end of the instrument opposite said barrel.

9. A method of mounting a shank portion of a mouthpiece on a brass musical instrument having a leadpipe, comprising the steps of:

providing a first member coupled in a fixed relation relative to said leadpipe, said first member coupled as an integral member of said instrument;

engaging said mouthpiece shank with a receiving member;

placing said receiving member in threaded engagement with said first member; and moving said receiving member longitudinally relative to said first member, changing the distance between a selected portion of said mouthpiece and a selected point on said leadpipe.

10. An adjustable receiver configured to couple a mouthpiece to a brass instrument having a leadpipe comprising:

a barrel configured for coupling to said leadpipe, said barrel defining a first bore and a threaded bore, said first bore and said threaded bore generally coaxially aligned with one another; and a sleeve defining a second bore, said second bore defined by surfaces configured to establish complimentary mechanical contact with a portion of said mouthpiece, said sleeve further having a first external surface configured to engage said first bore of said barrel, and further having an external threaded surface configured to engage said threaded bore of said barrel.

11. The adjustable receiver of claim 10, further comprising a locking member movable between a first state wherein it allows movement between said receiving member and said barrel assembly and a second state where it restricts movement between said receiving member and said barrel assembly.

12. The receiver of claim 10, wherein said second bore has surfaces defining a taper generally coinciding with a taper defined by a first diameter of 0.590 inch and a second diameter of 0.525 inch separated by a distance of 1.395 inches.

* * * * *